US006513807B1

(12) United States Patent
Lynch

(10) Patent No.: US 6,513,807 B1
(45) Date of Patent: Feb. 4, 2003

(54) GAMING APPARATUS AND METHOD FOR PLAYING A GAME THEREWITH

(76) Inventor: James P. Lynch, 6807 Dudley Cir., Arvada, CO (US) 80004

( * ) Notice: Subject to any disclaimer, the term of this patent is extended or adjusted under 35 U.S.C. 154(b) by 0 days.

(21) Appl. No.: 09/947,661

(22) Filed: Sep. 6, 2001

(51) Int. Cl.[7] ..... A63F 7/02

(52) U.S. Cl. ..... 273/119 R; 273/123 R; 273/126 R

(58) Field of Search ..... 273/118 R, 119 R, 273/123 R, 108, 108.1, 118 A, 119 A, 123 A, 126 R

(56) References Cited

U.S. PATENT DOCUMENTS

| | | | | | |
|---|---|---|---|---|---|
| 635,059 | A | * | 10/1899 | Pike | 273/123 R |
| 739,337 | A | * | 9/1903 | Newman | 273/119 R |
| 1,195,173 | A | * | 8/1916 | Beamer et al. | 273/118 R |
| 1,622,877 | A | * | 3/1927 | McMann | 206/102 |
| 3,912,272 | A | * | 10/1975 | Hicks et al. | 273/119 R |
| 4,431,186 | A | * | 2/1984 | Gold | 273/123 R |
| 5,029,863 | A | * | 7/1991 | Krawczyk et al. | 273/113 |
| 6,279,904 | B1 | * | 8/2001 | Huang | 273/118 A |
| 6,390,470 | B1 | * | 5/2002 | Huang | 273/118 A |

* cited by examiner

*Primary Examiner*—Raleigh W. Chiu
(74) *Attorney, Agent, or Firm*—Timothy J. Martin; Michael R. Henson; Rebecca A. Gegick

(57) ABSTRACT

A gaming apparatus and method includes a table with a cushion on its perimeter and centrally located target area. The target area includes an elongated barrier to prevent passage of a ball and a primary target formed as a bay having opposed side walls and an open mouth to receive a ball. The target array in one embodiment includes a base rail and transverse end rails. A plurality of primary targets are located in spaced relation along the base rail with regions between the primary targets defining secondary targets. The primary targets accept different integral numbers of balls that may be launched from a tee area against the cushion to score points. Guides having converging walls direct incident balls toward the mouths of the primary targets. A mallet is used to strike each ball of a player's ball set during play.

45 Claims, 6 Drawing Sheets

GAMING APPARATUS AND METHOD FOR PLAYING A GAME THEREWITH

FIELD OF THE INVENTION

The present invention generally relates to structures and apparatus, systems and methods for use in playing games. More particularly, the present invention is directed to a game table for use in playing a game that uses at least one ball of a selected diameter. Additionally, the present invention includes a game set for use in playing a game and a method of playing a game using a game set according to the present invention.

BACKGROUND OF THE INVENTION

Games have been an integral part of life for thousands of years. In many ancient cultures around the world, man's gregarious and social nature motivated the pursuit of many leisure activities that attracted the participation of both men and women. Many of these leisure activities involved competition relating to sports and exercise activities. Perhaps the best known of all ancient games is the Olympic Games, which derived from a Greek religious festival held in Olympia, Greece every four years. In modern times, the Olympic Games have not only achieved a valued form of social interaction among the participants, but also promote an understanding and friendship among the participating nations worldwide.

As in the past, games continue to provide an excellent forum for stimulating social interaction, and perhaps most importantly, as a source of fun. During large social occasions such as weddings and parties, games create a means for inspiring interaction among the guests, adding more life to the party and keeping them entertained so as to prevent boredom. Even in smaller settings, such as the kitchen table, games provide an opportunity for many families and friends to spend quality time with each other, in addition to a welcome relief from the monotony of watching television shows, movies, and video games. Modern day technology has even added a new dimension to the overall scheme of social interaction. For example, the Internet now serves as a new forum for online multiplayer games, permitting interaction with other players who very likely are participating from computers located all around the world.

Today, games exist in a large variety of categories including card games, board games, multi-player games, single-player games, arcade games, computer games, and the like. One popular category of games includes table games, such as pool or billiards. Pool tables have become a very popular and common staple of entertainment in many homes and in many social gathering places such as bars, pubs and the like. However, dedicated pool players often have a great deal of acquired skill, such that other persons wishing to play pool in public areas may feel intimidated. Further, many persons may ultimately become bored with this common table game, such that business establishments might attract patrons by providing an alternative thereto. Accordingly, a need exists in the art for a new and improved game and apparatus for use therewith, such as a game that can be enjoyed by many people in both public gathering places and private homes. The present invention is directed to meeting these needs.

SUMMARY OF THE INVENTION

It is an object of the present invention to provide a new and useful game table for use in playing a game.

It is another object to provide a game table that can be provided by business establishments of public gathering places for the entertainment of customers.

It is yet another object to provide a game set including various items for playing a game according to the present invention.

A still further object is to provide a method for playing a game that can be played by persons of varying degrees of skill therein.

According to the present invention, then, a game table is provided for use in playing a game that uses at least one ball of a selected diameter. The game table comprises a play area having a surface including a central region and a surrounding perimeter, a cushion disposed along at least a portion of the perimeter, and a target array disposed in the central region and including an elongated barrier structure having a selected length and extending through a portion of the central region and operative to prevent direct passage of a ball therepast, and at least one primary target sized and adapted to receive and retain therein at least one ball of the selected diameter, each primary target including a pair of opposed side wall portions configured to form a ball receiving bay that is operative to retain a ball received therein, and an open mouth of a width sized to receive the ball therethrough, thereby to allow the ball to enter the ball receiving bay.

The surface may extend entirely in a plane, and the game table may include a layer of a felt fabric that extends across the play area to define the surface. The surrounding perimeter of the play area may define a circular, ovoid or polygonal shape, and an outer perimeter of the game table may be contiguous with the surrounding perimeter of the play area. The cushion may extend along a majority of the surrounding perimeter, and may comprise a resilient material extending inwardly from therefrom. The elongated barrier structure may be discontinuous along the length thereof, and may be linear, curvilinear, V-shaped or stair-stepped. At least one end rail may extend transversely from an end portion thereof. The primary target may be disposed adjacent to or spaced apart from the elongated barrier structure, and a plurality of primary targets may be disposed in the central region. At least one secondary target may be defined on one side by the elongated barrier structure and on another side by a side wall portion of a primary target, and at least some secondary targets may each be interposed between adjacent ones of the primary targets. Each side wall portion may include an inner face adjacent the ball receiving bay, an outer face opposite the inner face, and a shoulder interconnecting the inner face and the outer face and oriented at an acute angle to the inner face.

The ball receiving bay may have a width at least as great as the selected diameter of the ball and a length configured such that when the ball receiving bay is filled with balls, from half to a major portion of an outermost ball is in the ball receiving bay and from half to a minor portion of the outermost ball extends outside of the ball receiving bay. The length may be approximately $(n-\frac{1}{2})d$ and the width approximately d, where d is the selected diameter and where n is an integer.

A pair of opposed guide walls may be configured to form a chute having an entryway wider than the open mouth and an exit wider than the selected diameter, where the opposed guide walls are oriented to direct a ball received therethrough toward the open mouth. At least a portion of each pair of opposed guide walls may converge in a direction toward the open mouth; a portion of each guide wall may also be curvilinear. The pair of opposed guide walls may be symmetric about a central axis extending through the open mouth, and each guide wall may be connected to the surface by a fastener including a dampening element, such as a polymeric washer, operative to absorb an impact of one of the balls against the guide wall thereby to minimize a rebound of the ball off of the guide wall.

The present invention also relates to a game set for use in playing a game, comprising a plurality of balls of a selected diameter, a game table, an annular tee adapted to be placed between one of the plurality of balls and the surface thereby to releasably retain the ball in a selected location on the surface, and a striking instrument having a face adapted to contact one of the balls whereby the striking instrument can be used by a player of the game to strike the ball thereby to propel it across the play area toward the perimeter.

The plurality of balls may include a first set of balls of a first color and a second set of balls of a second color different from the first color. The game set may further include a pad having a selected geometric configuration and a selected thickness and adapted to be placed between the surface and the annular tee, thereby to minimize the impact of the striking instrument against the surface. The striking instrument is preferably a hammer having an elongated head and a handle extending therefrom, where the elongated head may include a centralized bore and a metal weight disposed therein. The metal weight may protrude from at least one end of the elongated head, and a layer of material, such as a leather pad, may be adhered to a portion of the metal weight that protrudes from the elongated head.

A support structure, such as one including a plurality of legs of various heights, may be provided that is adapted to be placed on a horizontal support surface and support the game table at an acute angle with respect to the horizontal support surface, whereby the game table has a lower edge, an upper edge and first and second side edges. A tee area may be located medially between the first and second side edges of the game table and between the target array and the lower edge of the game table Finally, the present invention relates to a method of playing a game using a plurality of balls, an annular tee, a striking instrument having a face adapted to contact one of the balls, and a game table that includes a play area having a surrounding perimeter and a target array that includes a plurality of targets having score values. The method comprises placing one of the balls on the tee in a selected location on the surface, striking the ball with the striking instrument thereby to propel the ball across the play area toward the perimeter, such that balls incident to the perimeter are redirected across the play area as reflected balls, repeating the placing and striking steps with each one of the balls, and calculating a score of the game by tallying the score values correlating to the position of each one of the balls relative to the targets.

Two players may alternately each perform the placing and striking steps on a selected number of balls of a respective first type and second type corresponding to each player. The step of striking the ball may be accomplished by swinging a hammer in an arc disposed in a generally horizontal plane. The method may be performed such that a first ball is propelled in a first direction across the play area and a second ball is propelled in a second direction across the play area that is generally opposite from the first direction. The step of striking the ball may further be accomplished to direct the ball around an elongated barrier structure and into the target array. The step of calculating a score may include tallying a respective score for each ball in a respective target.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention provides a game table for use with a game as described herein. The game table is generally manufactured in accordance with a standard understanding in the art for manufacturing tables for use with various games such as pool and billiards. In particular, while the materials for construction of such a game table according to the present invention are similar to those for constructing a pool table, the configuration thereof is as described hereinbelow.

Figure 1:
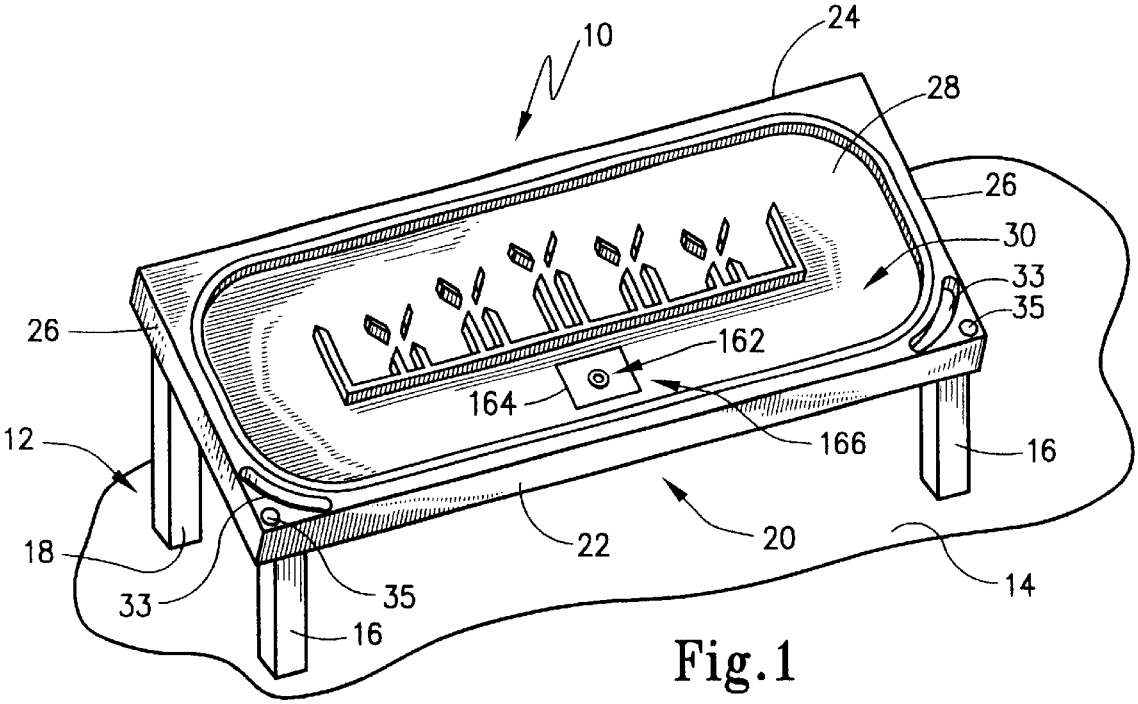
FIG. 1 is a perspective view of a game table and support structure according to a first embodiment of the present invention.
Figure 2:
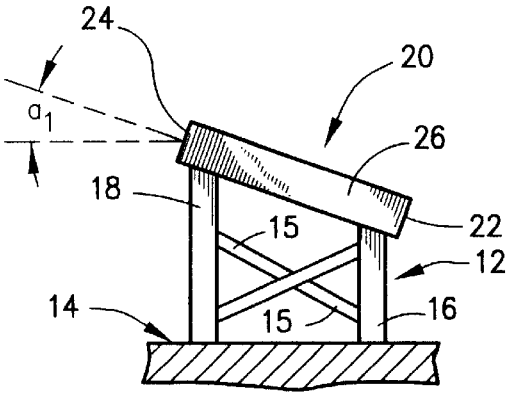
FIG. 2 is a side view in elevation of the game table and support structure of FIG. 1 on a horizontal support surface.

Turning to FIGS. 1 and 2 then, a gaming apparatus 10 according to a preferred embodiment of the present invention includes a support structure 12 and a game table 20. Support structure 12 is adapted to be placed on a horizontal support surface 14 such as a floor and to support game table 20 thereabove, preferably at an acute angle a, with respect to the horizontal support surface. Supported in this manner, game table 20 has a lower edge 22, upper edge 24 and side edges 26, and includes a planar top 28 defining a play area 30. It should be appreciated, however, that non-planar tops such as play areas including curved surfaces are contemplated by the present invention.

Figure 3:
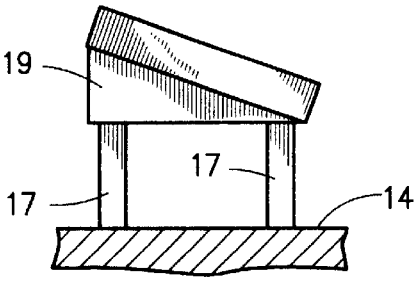
FIG. 3 is a side view in elevation of an alternative embodiment of a support structure for a game table according to the present invention.

It should be appreciated that a variety of support structures are contemplated. For example, the support structure may include a plurality of shorter front legs 16 and taller back legs 18 thereby to support table 20 at an acute angle as shown in FIGS. 1 and 2, or may include legs of equal lengths 17 in combination with a wedge-shaped structure 19, as shown in FIG. 3. Bracings 15 may be included to provide further structural support as known in the art.

Figure 4:
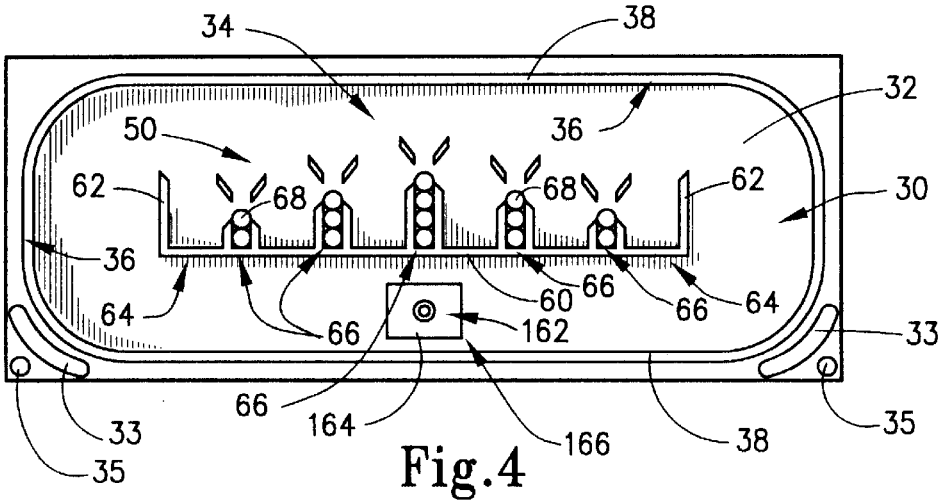
FIG. 4 is a top plan view of the game table of FIG. 1 showing a plurality of balls disposed in the primary targets thereof.

Turning to FIG. 4, it can be seen that play area 30 has a surface 32 including a central region 34 and a surrounding perimeter 36. Here, play area 30 is shown as generally ovoid in shape, although play area 30 may be other configurations such as circular or polygonal.

Surface 32 preferably extends entirely in a plane, although surface 32 may be non-planar, such as including one or more curved surfaces and/or surfaces disposed in a plurality of planes. A cushion 38, similar to a pool table cushion, is disposed along at least a portion of perimeter 36. While cushion 38 is shown here as extending entirely along perimeter 36, it should be appreciated that cushion 38 may be discontinuous or may extend along only a portion of perimeter 36. For optimum play, cushion 38 extends along a majority of perimeter 36. Ball holders 33 are provided in game table 20 as grooves or depressions sized to receive a plurality of balls for storage therein. Cylindrical bores 35 are provided in game table 20 to receive for storage therein a handle of a striking instrument, such as a hammer, as discussed below.

A target array 50 is disposed in central region 34 and includes an elongated barrier structure 60 that extends along its length through a portion of central region 34. Elongated barrier structure 60 is preferably a rail 61 made of a material such as wood, and is operative to prevent direct passage of a ball therepast. End rails 62 preferably extend transversely (including right angles and oblique angles) to rail 61 and end portion 64 of elongated barrier structure 60. Target array 50 includes at least one and preferably a plurality of primary targets 66 sized and adapted to receive and retain therein at least one ball 68. Balls 68 are preferably formed of a non-resilient material, and may be similar or identical to a pool ball, although it should be appreciated that balls are contemplated that may be formed of other materials, such as resilient materials including rubber and the like. Primary targets 66 are preferably disposed adjacent elongated barrier structure 60 as shown in FIG. 4.

Figure 5:
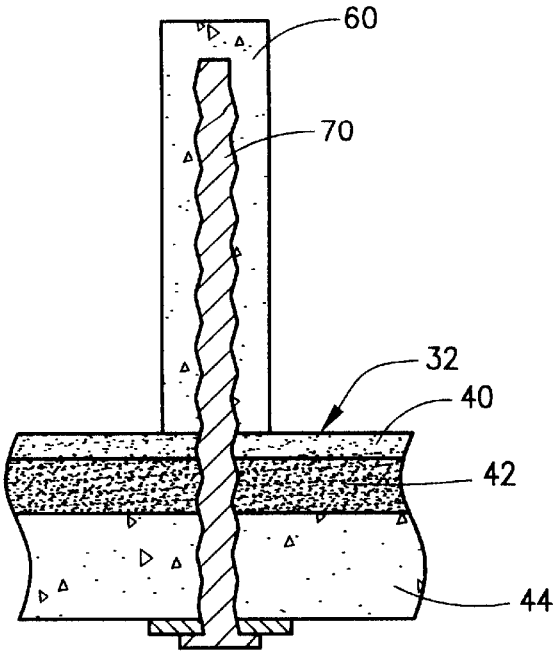
FIG. 5 is a side view in cross-section of a portion of the game table of FIG. 1 including a rail structure affixed to a surface thereof.
Figure 6:
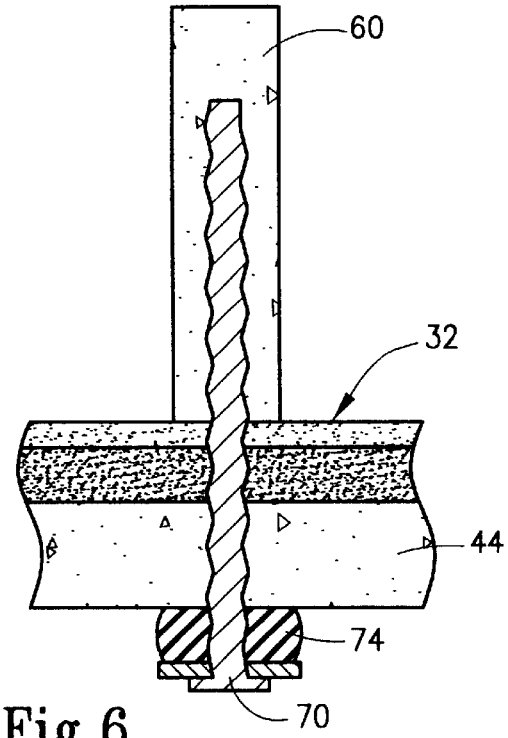
FIG. 6 is a side view in cross-section of a portion of the game table of FIG. 1 including a dampened rail structure affixed to a surface thereof.
Figure 7:
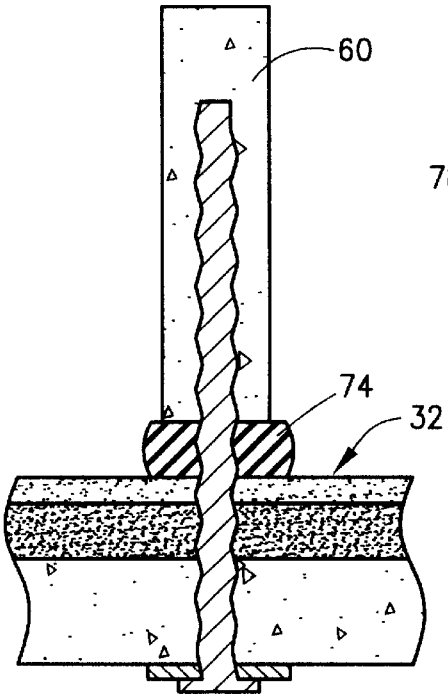
FIG. 7 is a side view in cross-section of a portion of the game table of FIG. 1 including an alternative dampened rail structure affixed to a surface thereof.

It can be seen from FIG. 5 that game table 20 preferably includes a layer of felt fabric 40 that extends across play area 30, where the felt fabric 40 defines surface 32. Felt fabric 40 is preferably disposed across a layer of slate 42 or other similar material as used in the art of pool table manufacture. Slate 42 may further rest on a wood panel 44 for support. Rail structures such as elongated barrier structure 60, or side wall portions or guide walls as discussed below, may be connected to surface 32 by a fastener 70, such as a bolt or screw, extending through surface 32. Washer 72 may be used with fastener 70 as known in the art. As shown in FIG. 6, rail structures such as elongated barrier structure 60 may be dampened by a dampening element 74, such as a polymeric washer. Here, dampening element 74 is disposed directly adjacent wood panel 44 on an opposite side of the game table from surface 32. Fastener 70 extends through a portion of surface 32, dampening element 74 and elongated barrier 60. Dampening element 74 is thus operative to absorb an impact of a ball against elongated barrier 60, or another rail structure as discussed below, thereby to minimize the rebound of the ball off of the rail structure. Alternatively, as shown in FIG. 7, dampening element 74 may be disposed directly between surface 32 and elongated barrier 60 or another rail structure as discussed below.

Figure 8:
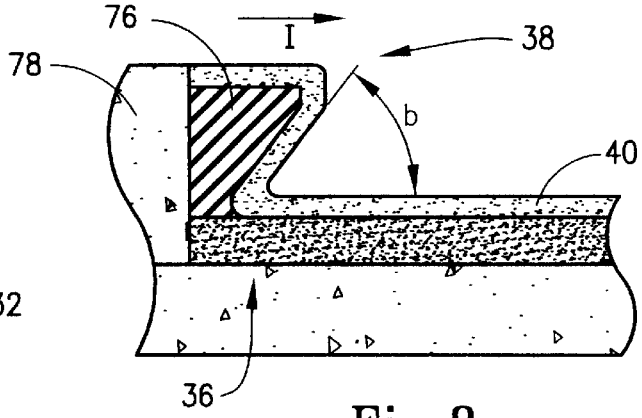
FIG. 8 is a side view in cross-section of a portion of the game table of FIG. 1 including a cushion along a perimeter of a play area thereof.

As shown in FIG. 8, cushion 38 is configured in the manner of a pool table bumper, and preferably comprises a resilient material such as a rubber bumper 76 disposed along perimeter 36 adjacent a surrounding outer margin portion 78 of the game table, which may be formed of a material such as wood. Cushion 38 is preferably configured such that it extends inwardly a direction I from perimeter 36 and has an undercut formed at an acute angle "b". Layer of felt fabric 40 is preferably wrapped around cushion 38 as known in the art of pool table manufacture. Cushion 38 is provided to redirect a ball incident to the perimeter and impacting with cushion 38 during play back across the play area as a reflected ball. Alternatively, it should be appreciated that when the balls are themselves formed of a resilient material, such as rubber or the like, cushion 38 may be formed of a non-resilient material, such as wood, such that a resilient ball impacting with cushion 38 will rebound therefrom.

Figure 9:
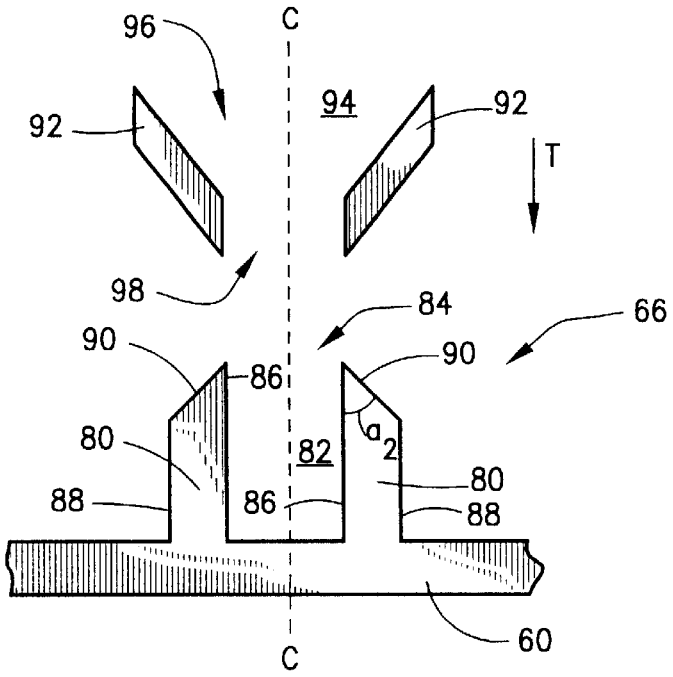
FIG. 9 is a top plan view of a primary target of the game table of FIG. 1 and a chute therefor.

Turning to FIG. 9, it can be seen that a primary target 66 includes a pair of rail structures in the form of opposed side wall portions 80 that are configured to form a ball receiving bay 82 having an open mouth 84. Open mouth 84 is of a width sized to receive a ball therethrough, thereby to allow the ball to enter ball receiving bay 82, which is operative to retain a ball received therein. Preferably, side wall portions 80 extend transversely to elongated barrier structure 60 and are adjacent thereto such that ball receiving bay 82 is defined on two sides thereof by side wall portions 80 and on a third side thereof by elongated barrier structure 60. Side wall portions 80 may be integral with elongated barrier structure 60 or may be provided as separate rail structures disposed adjacent to or alternatively spaced apart from elongated barrier structure 60. Both elongated barrier structure 60 and side wall portions 80 may be dampened as shown, for example, in FIGS. 6 and 7 as discussed above. Each of side wall portions 80 may include an inner face 86, an outer face 88 opposite inner face 86, and a shoulder 90 interconnecting inner face 86 and outer face 88. Shoulder 90 is preferably oriented at an acute angle $a_2$ to inner face 86, although it should be appreciated that shoulder 90 may alternatively be oriented at right or obtuse angles to inner face 86 or may be curved or of other configuration. Side wall portions 80 are preferably oriented generally parallel to one another.

A pair of rail structures such as opposed guide walls 92 are configured to form a chute 94 having an entryway 96 wider than open mouth 84 and an exit 98 wider than a selected diameter of balls for use with the game table. Opposed guide walls 92 are oriented to direct a ball received therethrough toward open mouth 84 and into ball receiving bay 82. At least a portion, and preferably all, of the pair of opposed guide walls 92 converge in a direction T toward open mouth 84 as shown in FIG. 9. The pair of opposed guide walls 92 are preferably symmetric about a central axis C extending through open mouth 84. Opposed guide walls 92 may be dampened as discussed above, for example, with respect to FIGS. 6 and 7.

Figure 10:
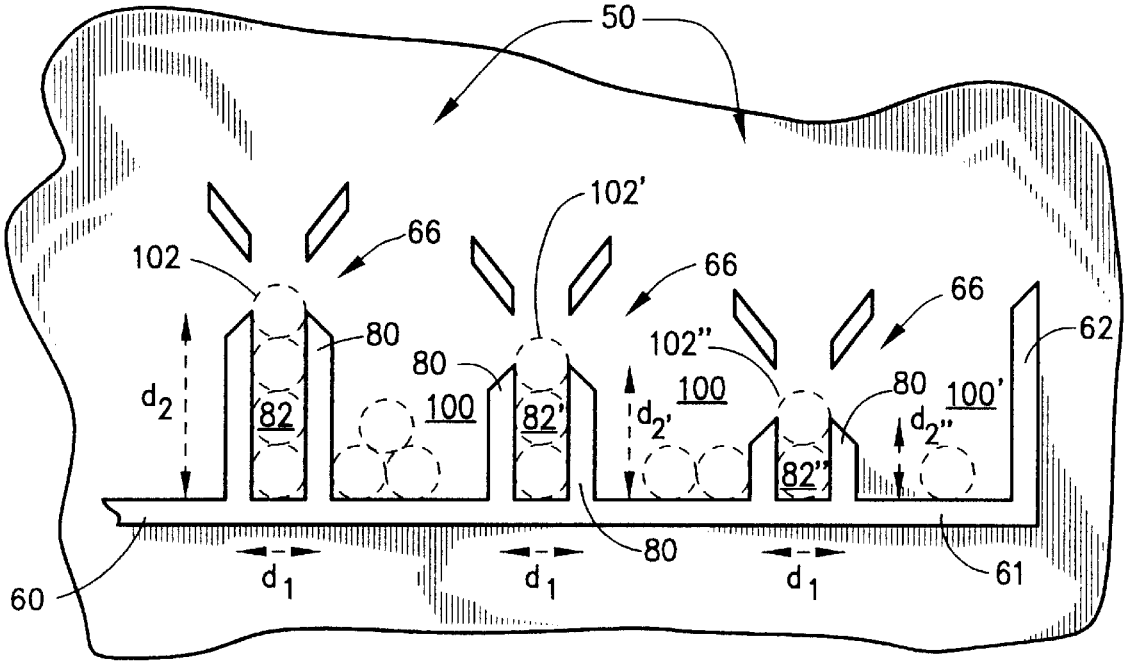
FIG. 10 is a top plan view of a portion of a target array of the game table of FIG. 1 showing in phantom a plurality of balls disposed in primary and secondary targets thereof.

As shown in FIG. 10, target array 50 preferably includes a plurality of primary targets 66 as described above with reference to FIG. 9. Target array 50 also includes at least one secondary target 100 interposed between adjacent ones of primary targets 66 and defined by elongated barrier structure 60 on one side thereof and further defined on another side by one of side wall portions 80 of a primary target 66. An outer secondary target 100' may be defined on one side by end rail 62. A plurality of primary targets 66 are preferably disposed in spaced apart relation to one another and adjacent to elongated barrier structure 66 as shown in FIG. 10 thereby to form a plurality of secondary targets 100 adjacent to elongated barrier structure 66.

As further shown in FIG. 10, each ball receiving bay 82, 82' and 82" has a width $d_1$ at least as great as the diameter of the balls for use with the game table. Each ball receiving bay 82, 82' and 82" also has a length $d_2$, $d_2'$ and $d_2''$, respectively, configured such that when the ball receiving bay is filled with balls as shown in phantom in FIG. 10, from half to a major portion of an outermost ball 102, 102' and 102", respectively, is in the ball receiving bay and from half to a minor portion extends outside of the ball receiving bay. Preferably, each ball receiving bay is configured such that approximately half of each outermost ball extends outside of the ball receiving bay when it is filled with balls. With this construction, the portion of the outermost ball that resides out of the bay when it is filled causes any other balls to be deflected from the mouth of the bay by the curvature of the outermost ball. The length of ball receiving bays thus configured can be formulated as $(n-\frac{1}{2})d$ where d is the selected diameter of the balls and where n is an integer reflecting the number of balls that can be received in a selected ball receiving bay. For example, the length of ball receiving bays 82, 82' and 82" in FIG. 10 may be given by the above formula where n is respectively 4, 3 and 2. The width of ball receiving bays 82, 82' and 82", respectively, is at least d. Target array 50 preferably includes at least three primary targets, wherein the length of a first primary target corresponds to n being 2, the length of a second primary target corresponds to n being 3, and the length of a third primary target corresponds to n being 4, as shown in FIG. 10.

Figure 11:
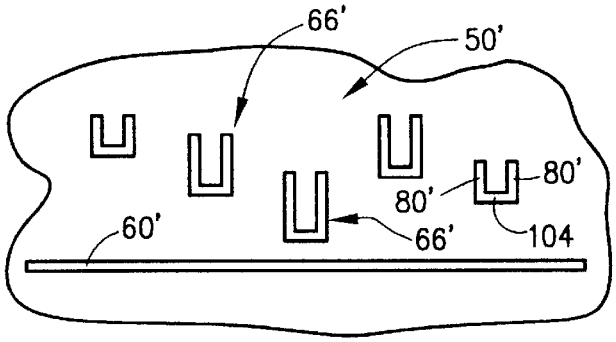
FIG. 11 is a top plan view of a portion of an alternative target array according to the present invention.

In an alternative embodiment of a target array 50' as shown in FIG. 11, at least one, and preferably each, primary target 66' may be spaced apart from an elongated linear barrier structure 60' by various distances. Here, a bottom rail structure 104 interconnects side wall portions 80'.

Figure 12:
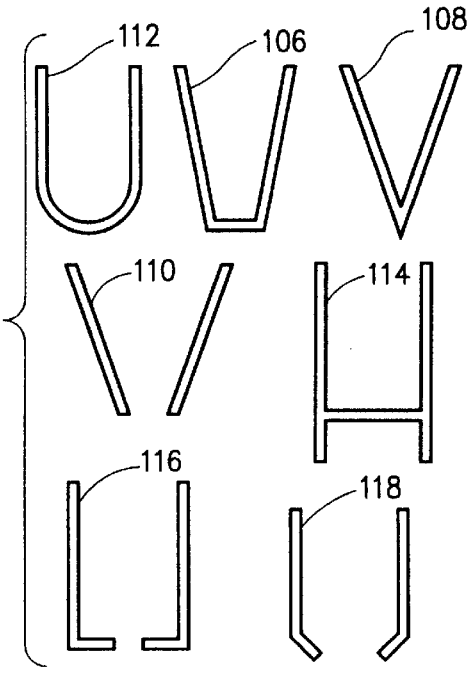
FIG. 12 is a top plan view of various alternative primary target configurations according to the present invention.
Figure 13:
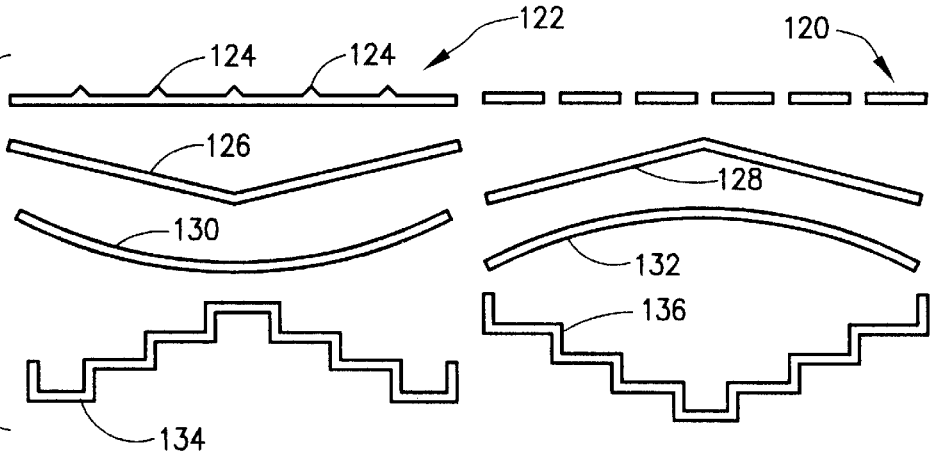
FIG. 13 is a top plan view of various alternative elongated barrier structure configurations according to the present invention.

FIG. 12 shows various other alternative embodiments of primary targets according to the present invention, including primary targets 106, 108 and 110 where side wall portions are oriented obliquely to one another in general "V" shapes, as well as primary target 112 having a general "U" shape, primary target 114 having a general "H" shape, and primary targets 116 and 118 having generally symmetrical "L"- or "J"- shaped sidewall portions. It should be understood that various other primary target configurations are contemplated by the present invention. FIG. 13 shows various other embodiments of elongated barrier structures, including linear elongated barrier structure 120 which is discontinuous along the length thereof, linear elongated barrier structure 122 which includes a plurality of projections 124 extending therefrom, elongated barrier structures 126 and 128 which are of a generally "V" shaped configuration, elongated barrier structures 130 and 132 which are of a curvilinear configuration, and elongated barrier structures 134 and 136 which are of a generally stair-stepped configuration. It should be appreciated that the present invention contemplates various other configurations for elongated barrier structures.

Figure 14:
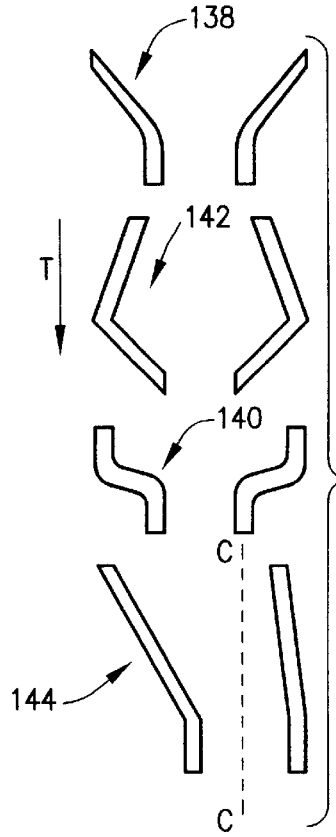
FIG. 14 is a top plan view of various alternative chute configurations according to the present invention.

FIG. 14 shows various other alternative embodiments of chutes according to the present invention, including chutes 138 and 140 in which at least a portion of each guide wall is curvilinear, chute 142 in which a portion of each pair of opposed guid walls diverge in a direction T toward an open mouth of a primary target, and chute 144 in which the pair of opposed guide walls are not symmetric about a central axis C.

Figure 15:
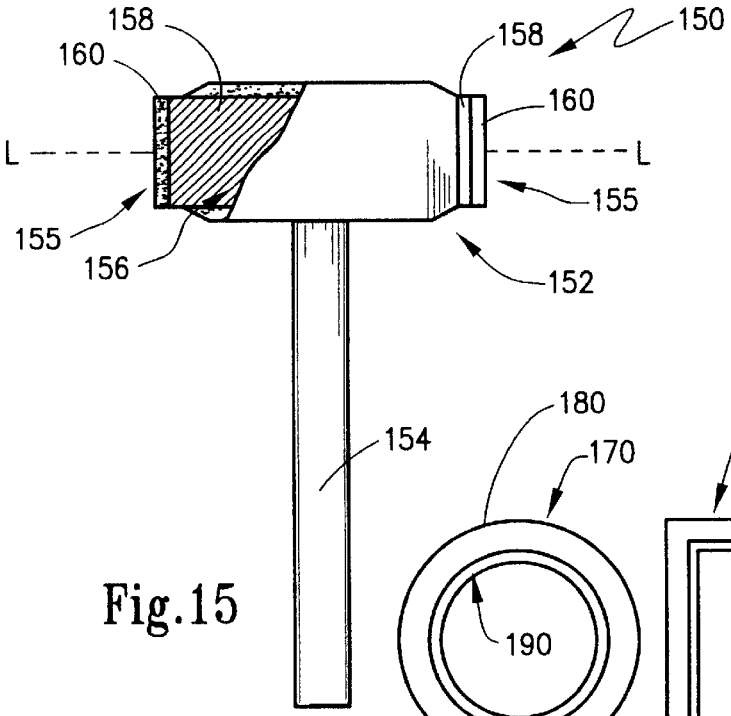
FIG. 15 is a side view in elevation and partial cross-section of a striking instrument according to the present invention.

Turning to FIG. 15, a striking instrument 150 is shown for use with the game table of the present invention. Striking instrument 150 can be used by a player of the game to strike a ball thereby to propel the ball across the play area toward the perimeter thereof, as further described below. Striking instrument 150 is preferably a hammer or mallet having an elongated head 152 and a handle 154 extending therefrom. Elongated head preferably includes a centralized bore 156 therein and a metal weight 158 disposed in centralized bore 156. It should be appreciated that centralized bore may extend entirely through elongated head 152 along an axis L thereof, or may extend only partly into elongated head 152. Metal weight 158 protrudes from at least one end of elongated head 152, and a layer of material 160 such as a leather pad may be adhered to a portion of metal weight 158 that protrudes from elongated head 152. Layer of material 160 thus provides a face 155 adapted to contact a ball. It should be appreciated that alternatively two separate centralized bores may be drilled into opposite ends of elongated head 152 and two separate metal weights 158 may be disposed therein to protrude from opposite ends of elongated head 152.

Figure 16:
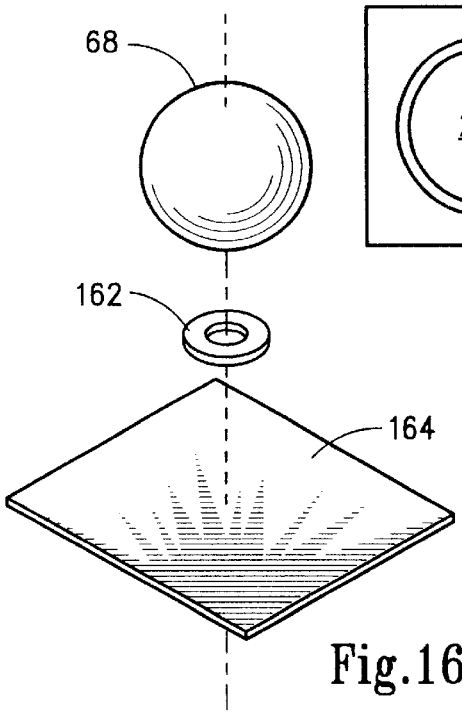
FIG. 16 is an exploded perspective view of a pad, tee and ball according to the present invention.

FIG. 16, together with FIGS. 1 and 4, show an annular tee 162 which may be placed under a ball 68 at a selected location on the surface of the game table thereby to retain the ball in the selected location until the ball can be hit by a striking instrument, such as that described above with respect to FIG. 15. Alternatively, a pad 164 having a selected geometric configuration and a selected thickness may be placed between the surface and the annular tee, thereby to protect the surface of the game table from damage which might be caused by the impact of the striking instrument thereagainst. Pad 164 is preferably a rectangular layer of material such as fabric, foam rubber or leather. Tee 162 is preferably placed in a tee area 166 located medially between side edges 26 and between target array 50 and lower edge 22 of game table 20. It should be appreciated that tee area 166 may alternatively include other means for releasably retaining a ball on the surface, such as a depression in surface 32, an adhesive material, a structural stop or the like.

Figure 17:
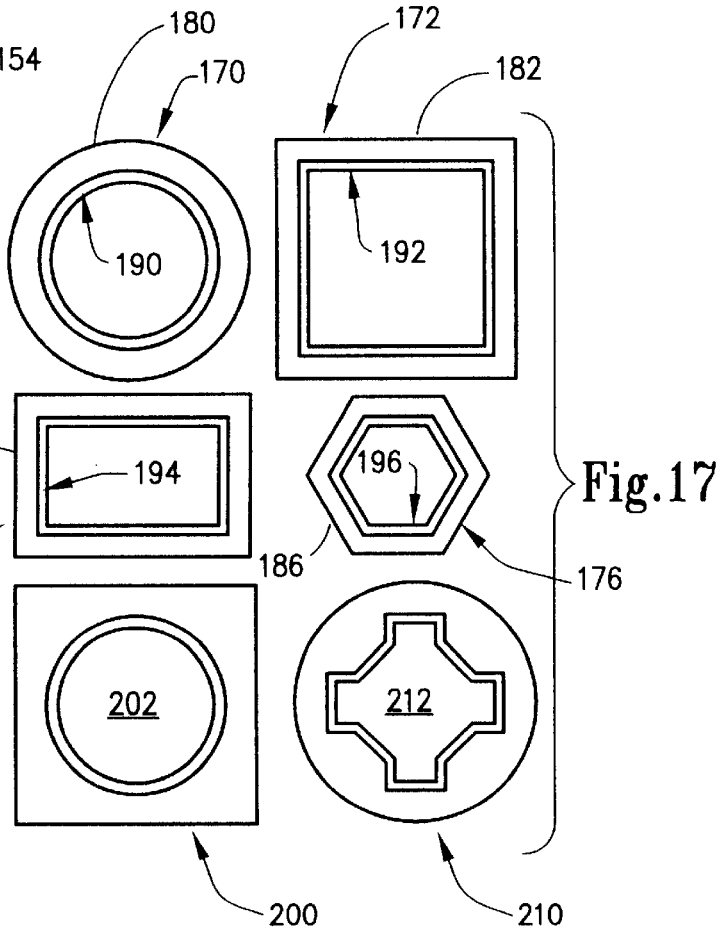
FIG. 17 is a top plan view of various alternative game table configurations according to the present invention.

As shown in FIG. 17, it should be appreciated that game tables according to the present invention may include play areas having shapes in a variety of configurations, including circular, ovoid and polygonal. Further, as shown in circular game table 170, square game table 172, rectangular game table 174 and hexagonal game table 176 in FIG. 17, an outer perimeter 180, 182, 184 and 186, respectively, of the game table may be contiguous with the surrounding perimeter of the play area 190, 192, 194 and 196, respectively. Alternatively, as shown with respect to square game table 200 having circular play area 202 and circular game table 210 having polygonal play area 212, it should be appreciated that game tables may be provided in shapes different from the shape of the play area thereof.

From the foregoing, it should be appreciated that the present invention also relates to a game set including a plurality of balls of a selected diameter, a game table, an annular tee and a striking instrument according to the present invention. The balls may be provided in two sets of a first type and second type respectively, such as where each set has a different color, thereby to accommodate play between two different players against one another as described below.

Figure 18:
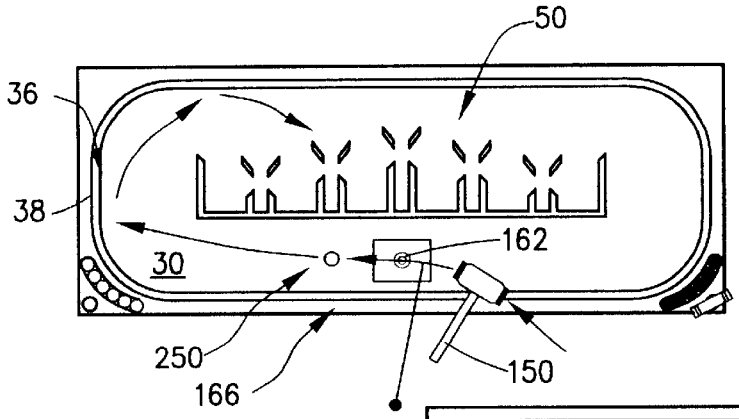
FIG. 18 is a top plan view of a game table according to the present invention at the beginning of a game played thereon.

Turning to FIGS. 18 through 22, it can be seen that the present invention also relates to a method of playing a game. As shown in FIG. 18, the game is preferably begun by placing a first ball 250 on the tee 162 in a selected location such as tee area 166 and striking ball 250 with a striking instrument 150 thereby to propel ball 250 across the play area 30 toward the perimeter 36, as shown by arrows, such that the ball impacts cushion 38 and is redirected across the play area toward the target array 50. It should be appreciated that balls incident to the perimeter 36 are redirected across play area 30 as reflected balls. The step of striking is preferably accomplished by swinging a hammer in an arc disposed in a generally horizontal plane and having a radius R, although it should be appreciated that individual players may prefer various other means of striking the ball with a hammer, or other types of striking instruments might be utilized. Alternatively, a game might be played in which a player throws or rolls a ball toward perimeter 36.

Figure 19:
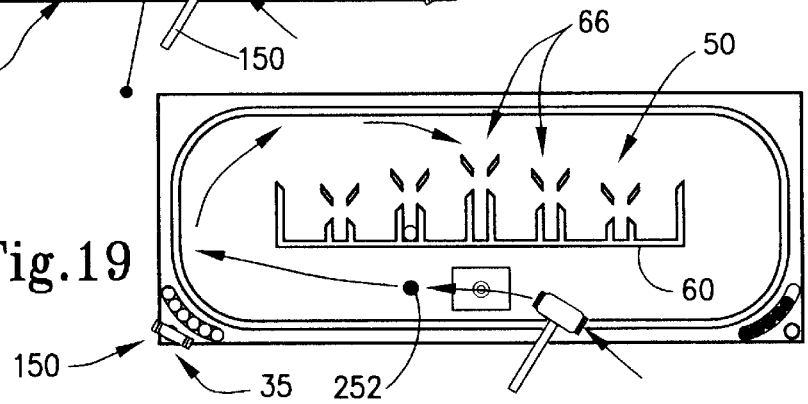
FIG. 19 is a top plan view of a game table according to the present invention during a game played thereon.
Figure 20:
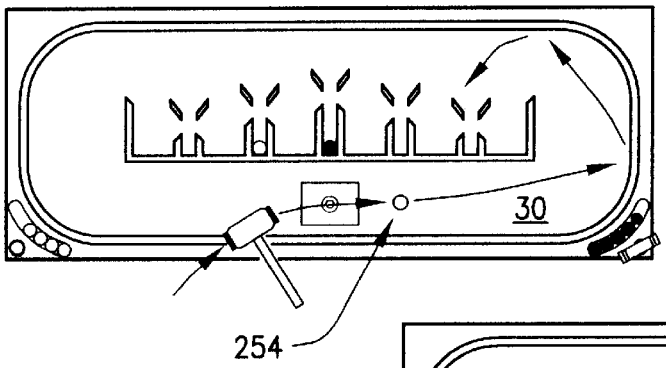
FIG. 20 is a top plan view of a game table according to the present invention during a game played thereon.
Figure 21:
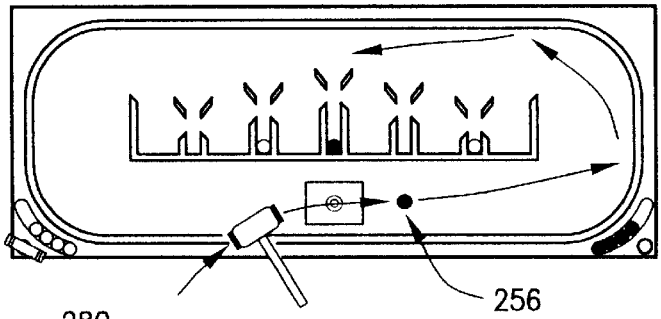
FIG. 21 is a top plan view of a game table according to the present invention during a game played thereon.

As shown in FIG. 19, the action of placing and striking a ball is repeated on another ball 252, which can be a ball of another type, such as of another color. Preferably, two players alternate in striking balls that respectively correspond to each player, with each attempting to direct the balls around elongated barrier structure 60 and into target array 50, and into primary targets 66 in particular. While another player takes a turn, a striking instrument 150 may be rested in a cylindrical bore 35, or in other means for storing a striking instrument such as a hook or the like. As shown in FIG. 20, in order to reduce advantages that might be achieved by right or left-handed persons, another ball 254 is propelled in an opposite direction across play area 30 from the direction in which the first ball was propelled by the player. That is, players may alternate their turns hitting to the right and left sides of play area 30, as shown by the second player hitting ball 256 also to the right side of play area 30 in FIG. 21.

Figure 22:
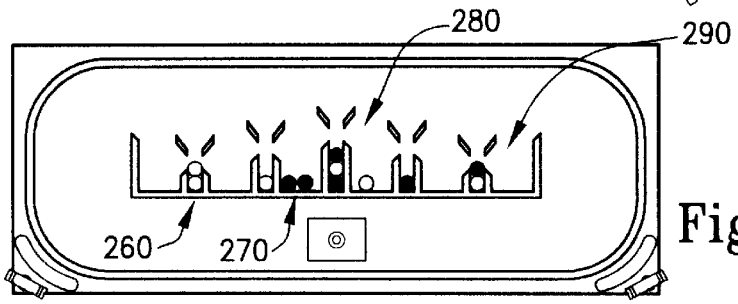
FIG. 22 is a top plan view of a game table according to the present invention at the end of a game played thereon.

FIG. 22 shows a possible outcome after a selected number of balls have been hit into the target array. A score may be calculated, such as a score for each player, by tallying score values correlating to the position of each one of the balls relative to the targets. For example, a specific score value may be assigned to each primary target, such as based on the difficulty of hitting a ball into that target, and each player's corresponding ball resting in a particular primary target receives the score value assigned thereto. For example, each player may receive a certain number of points for each corresponding ball resting in primary target 280 and a lesser number of points for each corresponding ball resting in primary target 290. Additional points may be granted to a player who entirely fills a primary target with balls corresponding to that player, as shown in primary target 260, for example. Also, points may be granted to balls resting in secondary targets, such as for a player who gets two or more corresponding balls within a single secondary target, as in secondary target 270, for example. Alternative games may include ones wherein one player can cancel out another player's points by hitting a ball into the same target, or where players each hit all of their selected corresponding balls in sequence without alternating among players. It should be appreciated from the foregoing that there are numerous ways in which scoring may be accomplished.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A game table for use in playing a game that uses at least one ball of a selected diameter, comprising:

(a) a play area having a surface including a central region and a surrounding perimeter;

(b) a cushion disposed along at least a portion of said perimeter; and (c) a target array disposed in said central region and including (1) an elongated barrier structure having a selected length and extending through a portion of said central region, said elongated barrier structure operative to prevent direct passage of a ball therepast, and (2) at least one primary target sized and adapted to receive and retain therein at least one ball of the selected diameter, each said primary target including (A) a pair of opposed side wall portions configured to form (i) a ball receiving bay that is operative to retain a ball received therein, and (ii) an open mouth of a width sized to receive the ball therethrough, thereby to allow the ball to enter said ball receiving bay.

2. A game table according to claim 1 wherein said surface extends entirely in a plane.

3. A game table according to claim 1 including a layer of a felt fabric that extends across said play area, said fabric defining said surface.

4. A game table according to claim 1 wherein said surrounding perimeter of said play area defines a shape selected from circular, ovoid and polygonal.

5. A game table according to claim 1 wherein an outer perimeter of said game table is contiguous with said surrounding perimeter of said play area.

6. A game table according to claim 1 wherein said cushion extends along a majority of said surrounding perimeter.

7. A game table according to claim 1 wherein said cushion comprises a resilient material extending inwardly from said surrounding perimeter of said play area.

8. A game table according to claim 1 wherein said elongated barrier structure is discontinuous along the length thereof.

9. A game table according to claim 1 wherein said elongated barrier structure is of a configuration selected from linear, curvilinear, V-shaped and stair-stepped.

10. A game table according to claim 1 including at least one end rail, said end rail extending transversely to the length of said elongated barrier structure from an end portion thereof.

11. A game table according to claim 1 wherein said at least one primary target is disposed adjacent to said elongated barrier structure.

12. A game table according to claim 1 wherein said at least one primary target is spaced apart from said elongated barrier structure.

13. A game table according to claim 1 including a plurality of primary targets disposed in said central region.

14. A game table according to claim 1 including at least one secondary target defined by said elongated barrier structure on one side thereof and further defined on another side thereof by one of said side wall portions of said at least one primary target.

15. A game table according to claim 1 wherein a plurality of primary targets are disposed in spaced apart relation to one another and adjacent to said elongated barrier structure thereby to form a plurality of secondary targets adjacent to said elongated barrier structure, at least some of said secondary targets each interposed between adjacent ones of said primary targets.

16. A game table according to claim 1 wherein each said side wall portion includes an inner face adjacent said ball receiving bay, an outer face opposite said inner face, and a shoulder interconnecting said inner face and said outer face, and wherein said shoulder is oriented at an acute angle to said inner face.

17. A game table for use in playing a game that uses at least one ball of a selected diameter, comprising:

(a) a play area having a surface including a central region and a surrounding perimeter;

(b) a cushion disposed along at least a portion of said perimeter; and (c) a target array disposed in said central region and including (1) at least one primary target sized and adapted to receive and retain therein at least one ball of the selected diameter, each said primary target including (A) a pair of opposed side wall portions configured to form (i) a ball receiving bay that is operative to retain at least one ball received therein, wherein said ball receiving bay has a width at least as great as the selected diameter of the ball and has a length configured such that when said ball receiving bay is filled with balls, from half to a major portion of an outermost ball is in said ball receiving bay and from half to a minor portion of said outermost ball extends outside of said ball receiving bay, and (ii) an open mouth of a width sized to receive one of the balls therethrough, thereby to allow the ball to enter said ball receiving bay.

18. A game table according to claim 17 wherein said length is approximately (n−½)d and said width is approximately d, where d is the selected diameter and where n is an integer.

19. A game table according to claim 18 including at least three primary targets wherein at least one primary target respectively corresponds to n being 2, 3 or 4.

20. A game table according to claim 17 wherein said opposed side wall portions are parallel to one another.

21. A game table according to claim 17 wherein said opposed side wall portions are oriented obliquely to one another.

22. A game table according to claim 17 including an elongated barrier structure extending through a portion of said central region, wherein said opposed side wall portions extend transversely to said elongated barrier structure.

23. A game table according to claim 17 wherein each said side wall portion includes an inner face adjacent said ball receiving bay, an outer face opposite said inner face, and a shoulder interconnecting said inner face and said outer face, and wherein said shoulder is oriented at an acute angle to said inner face.

24. A game table for use in playing a game that uses at least one ball of a selected diameter, comprising:

(a) a play area having a surface including a central region and a surrounding perimeter;

(b) a cushion disposed along at least a portion of said perimeter; and (c) a target array disposed in said central region and including (1) at least one primary target sized and adapted to receive and retain therein at least one ball of the selected diameter, each said primary target including (A) a pair of opposed side wall portions configured to form (i) a ball receiving bay that is operative to retain a ball received therein, and (ii) an open mouth of a width sized to receive the ball therethrough, thereby to allow the ball to enter said ball receiving bay; and (B) a pair of opposed guide walls configured to form a chute having an entryway wider than said open mouth and an exit wider than the selected diameter, said opposed guide walls oriented to direct a ball received therethrough toward said open mouth.

25. A game table according to claim 24 wherein at least a portion of each said pair of opposed guide walls converge in a direction toward the open mouth.

26. A game table according to claim 24 wherein at least a portion of each said guide wall is curvilinear.

27. A game table according to claim 24 wherein a portion of each said pair of opposed guide walls diverge in a direction toward the open mouth.

28. A game table according to claim 24 wherein said pair of opposed guide walls are symmetric about a central axis extending through the open mouth.

29. A game table according to claim 24 wherein each said guide wall is connected to said surface by a fastener including a dampening element operative to absorb an impact of one of said balls against said guide wall thereby to minimize a rebound of said ball off of said guide wall.

30. A game table according to claim 29 wherein said dampening element is a polymeric washer and wherein said fastener includes a bolt extending through a portion of said surface, said polymeric washer and said guide wall.

31. A game set for use in playing a game, comprising:

(a) a plurality of balls of a selected diameter;

(b) a game table, including:

(1) a play area having a surface including a central region and a surrounding perimeter;

(2) a cushion disposed along at least a portion of said perimeter; and (3) a target array disposed in said central region and including (A) at least one primary target sized and adapted to receive and retain therein at least one of said balls, each said primary target including (i) a pair of opposed side wall portions configured to form (a) a ball receiving bay that is operative to retain at least one of said balls received therein, and (b) an open mouth of a width sized to receive one of said balls therethrough, thereby to allow said ball to enter said ball receiving bay; and (c) an annular tee adapted to be placed between one of said plurality of balls and said surface thereby to releasably retain said ball in a selected location on said surface; and (d) a striking instrument having a face adapted to contact one of said balls that is releasably retained on said surface by said tee, whereby said striking instrument can be used by a player of the game to strike said ball thereby to propel said ball across said play area toward said perimeter.

32. A game set according to claim 31 wherein said plurality of balls includes a first set of balls of a first color and a second set of balls of a second color different from said first color.

33. A game set according to claim 31 including a pad having a selected geometric configuration and a selected thickness, said pad adapted to be placed between said surface and said annular tee, thereby to minimize an impact of said striking instrument against said surface.

34. A game set according to claim 31 wherein said striking instrument is a hammer having an elongated head and a handle extending therefrom.

35. A game set according to claim 34 wherein said elongated head includes a centralized bore therein and wherein a metal weight is disposed in said centralized bore.

36. A game set according to claim 35 wherein said metal weight protrudes from at least one end of said elongated head, and including a layer of material adhered to a portion of said metal weight that protrudes from said elongated head.

37. A game set according to claim 36 wherein said layer of material is a leather pad.

38. A game set for use in playing a game, comprising:

(a) a first set of a plurality of balls of a first type having a selected diameter;

(b) a second set of a plurality of balls of a second type having the selected diameter;

(c) a gaming apparatus including (1) a support structure adapted to be placed on a horizontal support surface, and (2) a game table supported by said support structure at an acute angle with respect to said horizontal support surface, whereby said game table has a lower edge, an upper edge and first and second side edges, said game table including:

(A) a planar top defining a play area having a surface including a central region and a surrounding perimeter;

(B) a cushion disposed along at least a portion of said perimeter; and (C) a target array disposed in said central region and including (i) at least one primary target sized and adapted to receive and retain therein at least one of said balls, each said primary target including (a) a pair of opposed side wall portions configured to form (1) a ball receiving bay that is operative to retain at least one of said balls received therein, and (2) an open mouth of a width sized to receive one of said balls therethrough, thereby to allow said ball to enter said ball receiving bay;

(c) a tee area located medially between said first and second side edges of said game table and between said target array and said lower edge of said game table, said tee area adapted to releasably retain one of said balls in a selected location on said surface; and (d) a striking instrument having a face adapted to contact one of said balls that is releasably retained in said tee area, whereby said striking instrument can be used by a player of the game to strike said ball thereby to propel said ball across said play area toward said perimeter.

39. A game set according to claim 38 wherein said support structure includes a plurality of legs of a first height and a plurality of legs of a second height greater than said first height.

40. A method of playing a game using a plurality of balls, an annular tee, a striking instrument having a face adapted to contact one of the balls, and a game table that includes a play area having a surrounding perimeter and a target array that includes a plurality of targets having score values, the method comprising:

(a) placing one of the balls on the tee in a selected location on the surface;

(b) striking the ball with the striking instrument thereby to propel the ball across the play area toward the perimeter, such that balls incident to the perimeter are redirected across the play area as reflected balls;

(c) repeating steps (a) and (b) with each one of the balls;

(d) calculating a score of the game by tallying the score values correlating to the position of each one of the balls relative to the targets.

41. A method according to claim 40 wherein two players alternately each perform steps (a) and (b) on a selected number of balls of a respective first type and second type corresponding to each player.

42. A method according to claim 40 wherein said striking instrument is a hammer and wherein the step of striking the ball is accomplished by swinging the hammer in an arc disposed in a generally horizontal plane.

43. A method according to claim 40 wherein a first ball is propelled in a first direction across the play area and wherein a second ball is propelled in a second direction across the play area that is generally opposite from said first direction.

44. A method according to claim 40 wherein the game table includes an elongated barrier structure extending through a portion of a central region of the play area between said selected location and the target array, and wherein the step of striking the ball is accomplished thereby to direct the ball around the elongated barrier structure and into the target array.

45. A method according to claim 40 wherein the step of calculating a score includes tallying a respective score for each ball in a respective target.

* * * * *